US007938925B2

(12) United States Patent
Cummings et al.

(10) Patent No.: US 7,938,925 B2
(45) Date of Patent: May 10, 2011

(54) METHOD AND APPARATUS FOR INCREASED SPLICING SPEED ON A CORRUGATOR WEB SPLICER

(75) Inventors: James A. Cummings, Phillips, WI (US); Jeffrey M. Stieber, Green Bay, WI (US); Paul S. Heidenreich, Phillips, WI (US)

(73) Assignee: Marquip, LLC, Phillips, WI (US)

( * ) Notice: Subject to any disclaimer, the term of this patent is extended or adjusted under 35 U.S.C. 154(b) by 1101 days.

(21) Appl. No.: 11/435,990

(22) Filed: May 17, 2006

(65) Prior Publication Data

US 2006/0261119 A1 Nov. 23, 2006

(51) Int. Cl.
*B65H 69/06* (2006.01)
*B65H 21/00* (2006.01)

(52) U.S. Cl. ..... 156/157; 156/504; 156/502; 242/551; 242/552

(58) Field of Classification Search ..... 156/157, 156/159, 502, 504; 242/551, 552, 554, 554.2, 242/554.5, 554.6, 555
See application file for complete search history.

(56) References Cited

U.S. PATENT DOCUMENTS

| | | | | | |
|---|---|---|---|---|---|
| 3,586,437 | A * | 6/1971 | Dietz et al. | 399/76 |
| 3,811,637 | A * | 5/1974 | Abler | 242/421.7 |
| 4,030,511 | A * | 6/1977 | Wahle | 131/280 |
| 4,170,506 | A * | 10/1979 | Marschke | 156/159 |
| 4,190,475 | A | 2/1980 | Marschke | |
| 4,219,378 | A | 8/1980 | Marschke | |
| 4,572,098 | A * | 2/1986 | Chiu | 118/33 |
| 4,875,633 | A * | 10/1989 | Mochizuki et al. | 242/554.2 |
| 5,461,450 | A * | 10/1995 | Long et al. | 396/661 |
| 5,564,253 | A * | 10/1996 | Nakaya | 144/356 |
| 5,881,964 | A * | 3/1999 | Fujikura et al. | 242/556.1 |
| 6,547,909 | B1 * | 4/2003 | Butterworth | 156/157 |
| 2003/0209629 | A1 * | 11/2003 | Hirata et al. | 242/554.2 |
| 2005/0061846 | A1 * | 3/2005 | Seaberg et al. | 226/118.3 |

* cited by examiner

*Primary Examiner* — Mark A Osele
*Assistant Examiner* — Nickolas Harm
(74) *Attorney, Agent, or Firm* — Andrus, Sceales, Starke & Sawall, LLP

(57) ABSTRACT

Clutch pressure or servo motor torque profiling is applied to the powered capstan roll in a corrugator web splicer to control tension in the paper in the accelerating new paper roll to bring the new roll up to line speed more quickly and without causing web tear out.

6 Claims, 4 Drawing Sheets

METHOD AND APPARATUS FOR INCREASED SPLICING SPEED ON A CORRUGATOR WEB SPLICER

BACKGROUND OF THE INVENTION

The web splicer of a corrugator is used to facilitate continuous operation of the web end. Corrugated board is comprised of three layers of paper including a top liner, a fluted medium and a bottom liner. A pair of top liner roll stands is located on the upstream side of a single facer that is used to bond the top liner web to the glued flute tips of a fluted medium paper. The medium enters the singlefacer from one of a pair of medium roll stands located downstream of the single facer. In a typical corrugated wet end operation, the medium is unwound from a roll stand, preconditioned with application of heat and steam and then fluted between a pair of corrugated rolls. The fluted medium, conforming to the flute profiles of one of the corrugated rolls, has a starch adhesive applied to the flute tips. The glued flute tips of the medium then come into contact with the top liner directly beneath a pressure roll or pressure belt system where a green bond forms between the liner and medium. This bond is facilitated by the preheating of the top liner after it unwinds from one of the pair of top liner roll stands.

The single face web, comprised of the top liner glued to the fluted medium, progresses down the corrugator bridge to a glue machine. The singleface web has a starch adhesive applied to the bottom flute tips at the glue machine. A bottom liner unwinds from one of a pair of roll stands located at the doublefacer roll stand position. The bottom liner is preheated after which it enters a doublefacer hot plate system. The singleface web with glued flute tips then also enters the doublefacer where it is pressed into intimate contact with the bottom liner on the hot plate by a weighted corrugated belt. The starch is cured by heat as the corrugated web proceeds through the doublefacer and then into the dry end of the corrugator. At the corrugator dry end the web is slit to desired widths according to an order set-up schedule and then cut to desired length by a cutoff knife. The slit and cut sheets are then stacked by a downstacking system.

It is very important to maintain the corrugator process as continuous, even during paper roll change over, to avoid substantial waste and downtime on the corrugator. If the corrugator were stopped for paper roll change, the starch bonding process at both the singlefacer and doublefacer would be interrupted creating substantial waste board. The start-up process is also problematic because of severe warp and loose spots that can cause jam-ups in the corrugator dry end.

To make the process continuous, automatic web splicers are used at the top liner, medium and bottom liner roll stand positions. The splicer is positioned above a pair of roll stands at each position. The predominant splicer technology used for splicing of corrugated web is a "zero speed" splicer. With this type of splicer, the paper of the expiring roll and the paper on the new roll are spliced by bringing the tail of the expiring roll web to zero speed.

Referring to FIGS. 1 and 2, the splicer contains a pair of splicer carriages 10, each of which contains a paper stop bar 11, cut-off knife 12 and splice sealing nip roll 13. A paper storage system 20, called the "dancer system," allows paper to be fed to the corrugator on a continuous basis as the splice is made at zero speed. A splicer roll accelerator system called the "capstan roll" 30, creates higher tension levels to pull the paper roll up to speed. The corrugator speed at which the splice can be completed is determined by the performance of each of these features of the splicer.

The splicer carriage stop bar 11 clamps the tail of the expiring web 14. The more quickly the expiring roll web is brought to a full stop for splice seal, the faster the corrugator splicer speed. After the expiring paper roll web 14 is stopped, the pair of splice sealing nip rolls 13 in the splicer are brought together nipping the leading edge of the new paper roll web 15 that has been prepared with a suitable adhesive tape. After the nip rolls come together, the cutoff knife 12 fires causing the expired paper roll web 14 to be severed. The webs are then pulled through the splicer sealing nip rolls 13. Pulling forces are provided by the tension in the paper web 14, supplied by the downstream process.

This tension is amplified by the capstan roll system 30 located within the splicer down stream from the splicer carriage 10. The capstan system 30 is a roller that is driven to provide additional pull on the paper to accelerate the new paper roll to corrugator speed. This capstan roll can be powered in such a fashion as to slip under the paper wrapped around the roll or to simply add pull by virtue of torque applied to the capstan roll if the roll does not slip. If the capstan roll slips under the paper, the increase in paper tension upstream of the capstan roll is controlled by the capstan equation with ratio of tension out to tension in equal to the naperian logarithmic equation, $e^{\mu\beta}$ where $\mu$ is the coefficient of friction of the paper to the capstan roll and $\beta$ is the angle of wrap around the roll in radians. In the case of a 180° wrap and a coefficient of friction of 0.35, the slipping capstan roll amplifies the nominal web tension by a factor of 3. This creates higher pulling forces that accelerate the paper roll up to speed quickly allowing higher operating splicer speed.

The third splicer system affecting splicer speed is the dancer system 20. With more paper stored in the dancer system there is a longer time to accelerate the paper roll after the splice is complete and a higher operating splicer speed.

Splicer operating speeds have been increased with succeeding technology advancements in each of the splicer functions. The paper stop bar 11 was introduced to decrease time to stop the expiring paper web 14 in the splicer carriage 10. There is a limitation to the aggressiveness with which the clamp bar can be used due to the "brittleness" of the paper. An excessive clamping force can cause a paper break out.

In preparation for splicer setup, the corrugator operator presses the carriage back button to automatically position the splicer carriage 10 in front of the new paper roll 16. The paper from the new roll is pulled up over the idler roll 17, through the paper stop bar assembly 11, and over the splice sealing roll 13. The paper is pulled out until all wrinkles have been removed from the web, at which time the operator actuates a push-button, causing the paper stop bar 11 to positively hold the web in this position. Adhesive transfer tape is then applied to the leading edge of the new web. A slight edge lead-in is now trimmed on both sides of the web 15 and the paper is cut across using the cutting guide to ensure squareness. The tape backing is peeled away, leaving the web leading edge with a deposit of adhesive. The paper stop bar 11 is released and the sealing roll 13 is indexed back to accurately position the leading edge of the new web 15 for splicing. The paper stop bar is then actuated to positively hold the web in position until the instant the splice has been made. The operator presses the carriage in button, causing the splicer carriage 10 to be driven to a position close to the expiring corrugator web. With the carriage fully in, the operator rolls back the roll 16 to remove the slack between the roll and the carriage. The operator then actuates the brake set push-button. The splicer is then set up to perform the splice.

Classic splicer designs have used a steel capstan roll 30 with slightly more than 180° of wrap. These capstan designs have amplified paper tension by a factor of 3 to create larger paper roll acceleration forces. It was thought that resulting paper tension levels approached the threshold of safety required to avoid paper tear outs at splice.

Paper storage system capacity has been increased in various splicer designs to achieve higher splicer speeds. Early splicer designs had a single dancer roll. Subsequent designs evolved to a dual dancer roll 20, as shown in FIGS. 1 and 4. Splicer frame lengths were increased to achieve greater paper storage capacity, as shown in FIG. 5. Space in-line on the corrugator limited these designs, so quad dancer splicers were introduced, as shown in FIG. 6. The quad dancer splicer required more vertical space above the roll stands. In addition to the space limitation associated with these expanded paper storage concepts, a paper storage roller inertia problem became extreme with the quad dancer design. This problem was related to the fact that as the splice was initiated, the dancer assembly was powered forward, requiring dancer rollers to slow commensurately. Because of the dancer roller inertia, the dancer rolls would slip beneath the paper while slowing. This produced a multiplicative capstan effect that momentarily reduced web tension out of the splicer to near zero. This was followed by a high tension pulse as the dancer assembly speed stabilized. To solve this problem, dancer roll brakes and dancer carriage brakes were introduced. This complicated the design adding to the cost of the already expensive quad dancer splicer and creating a maintenance issue with a large number of friction brakes.

FIG. 4 shows a double dancer short side frame splicer capable of splicing at 650 FPM. FIG. 5 shows a double dancer longer side-frame splicer capable of splicing at 1000 FPM. Demand for higher splicing speeds has developed as higher corrugator operating speeds have been introduced. The requirement to slow the corrugator for splicing adversely affects board quality and offsets the productivity advantage of a higher corrugator operating speed. For this reason the quad dancer splicer shown in FIG. 6 was developed. This machine allows splicing at speeds up to 1300 FPM.

SUMMARY OF THE INVENTION

The foregoing problems prompted a reexamination of the splicer design and a focus on the capstan system as a means of increasing the splicer speed. One aspect of the present invention involves the addition of a second capstan roll that would act in a multiplicative fashion, with the existing capstan roll. Such an arrangement is shown in FIG. 7. The center idler roll 50 located immediately above the splicer carriages 10 has a 90+° angle of wrap. With a steel to paper coefficient of friction of 0.35, the use of the center idler as an additional capstan adds a factor of 1.7 to the web tension between it and the existing capstan roll 30. Since the angular acceleration of the spliced-in roll is proportional to the square root of the paper tension, the 1.7 tension amplification factor provides a 30% speed increase. The addition of a center idler roller capstan motor therefore allows a double dancer splicer to match the 30% higher speed of the quad dancer splicer.

Carrying the multiplicative capstan idea a little further, it would be possible to incorporate three capstans on the machine to achieve yet greater splicer speed. This may be limited, however, due to tensile strength limitations of the paper, particularly the medium.

DETAILED DESCRIPTION OF THE PREFERRED EMBODIMENT

In accordance with the present invention, a higher splicing speed is attained, without resorting to quad dancer paper storage, by incorporating a multiplicative or profiled capstan roll concept. The function of the capstan roll 30 of the prior art, shown in FIGS. 1 and 4-6, is to amplify the tension out of the splicer between the capstan roll and the new paper roll to be spliced in. This is accomplished by driving the capstan roll 30 at time of splice. The torque put into the capstan roll adds tension on the infeed side of the capstan roll up to the point where the capstan roll slips, at which time tension amplification is limited to $e^{\mu\beta}$ where $\mu$ is the coefficient of friction of the paper being spliced to the capstan roll and $\beta$ is the angle of wrap of the paper around the capstan roll.

There are several ways to drive the capstan roll 30. A servomotor can be used to control the torque on the capstan. An alternative means of regulating the torque on the capstan roll is with a pneumatic slip clutch between an induction motor and the capstan roll. The clutch or servomotor is normally set at one level to control the capstan torque so that it does not cause a jerk on the web that could initiate a web tearout.

The motivation for development of the present invention is the recognition that there is an inherent limitation on the amount of torque that can be applied to the capstan roll before reaching the limit related to slipping of the paper on the roll. Ways to increase the torque include increasing the coefficient of friction of the capstan roll to the paper. This has problems in that use of a coating on the roll to achieve this objective makes the roll more expensive and is normally a short-term solution in that the coating on the roll wears. Also, the solution may be self-defeating in that higher coefficient of friction may require lower torque levels to prevent jerk on the web.

Figure 7:
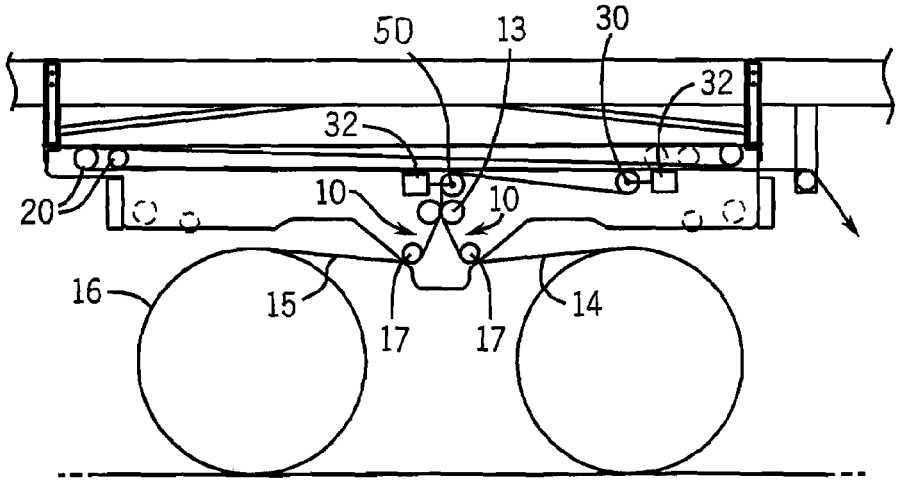
FIG. 7 is a schematic side elevation view of a splicer to which the improvement of the subject invention has been applied.

The addition of a second capstan increases web tension between the splicer and the paper roll to increase splicing speed. This concept is shown in FIG. 7. The addition of a second capstan allows the paper tension increase associated with the first capstan to be further increased by the second capstan 50. Tension increase limitations associated with slip of the web on the first capstan are overcome by further increasing tension with the second capstan. Tension levels on both capstans could be provided by servomotors, but induction motors with pneumatic clutches are a less costly solution.

A problem associated with the dual capstan idea is that for certain lightweight papers, the sudden increase in web tension associated with turning on the dual capstans to accelerate the new paper roll can create a jerk on the web causing it to fracture. To avoid this, the pressure to the clutch on the induction motor/pneumatic clutch or the additive torque level of a servomotor-driven capstan is reduced. This then limits the amount of torque transmitted to the capstan roll and reduces splicing speed.

To solve this problem, an aspect of the present invention is to introduce clutch pressure profiling or servomotor torque profiling to significantly reduce the jerk on the web as the capstan transitions from idler roll to powered roller. By using a variable pressure capstan clutch during the splice, as the capstan roll is turned on, the clutch pressure or servomotor torque (which is a function of clutch pressure) can be ramped up to achieve a capstan torque profile that gradually increases during the splicing sequence to achieve much higher paper tension change without jerking the roll. The addition of the capstan roll torque profiling to the dual capstan idea allows much higher average or net integrated tension levels between the splicer capstan system and the paper roll to achieve higher splicing speeds.

The clutch pressure profile or variable pressure capstan clutch concept of the present invention can also be applied to any splicer with a single induction-motor-driven capstan to achieve similar benefits.

The concept could also be applied to a servomotor apparatus wherein a servomotor torque is profile-controlled during the splicing process to achieve net integrated higher tension levels effecting higher splicing speed.

The addition of a capstan drive on any other roller with a 90° wrap, either an existing roller or an added roller, would provide the same multiplicative tension increase. For example, an additional set of rollers at the output of the splicer, designated to achieve at least a 90° wrap in one of the rollers, could be used to create a tension increase to the input side of the existing capstan roller 30 so that this new higher tension level would be multiplied by the existing capstan roller. This location for the multiplicative capstan may be less desirable than the center idler roll location because the paper path between this output roller and the paper roll may provide more opportunities for the higher tension levels to cause paper edge stress concentration that could cause paper rip out.

Figure 1:
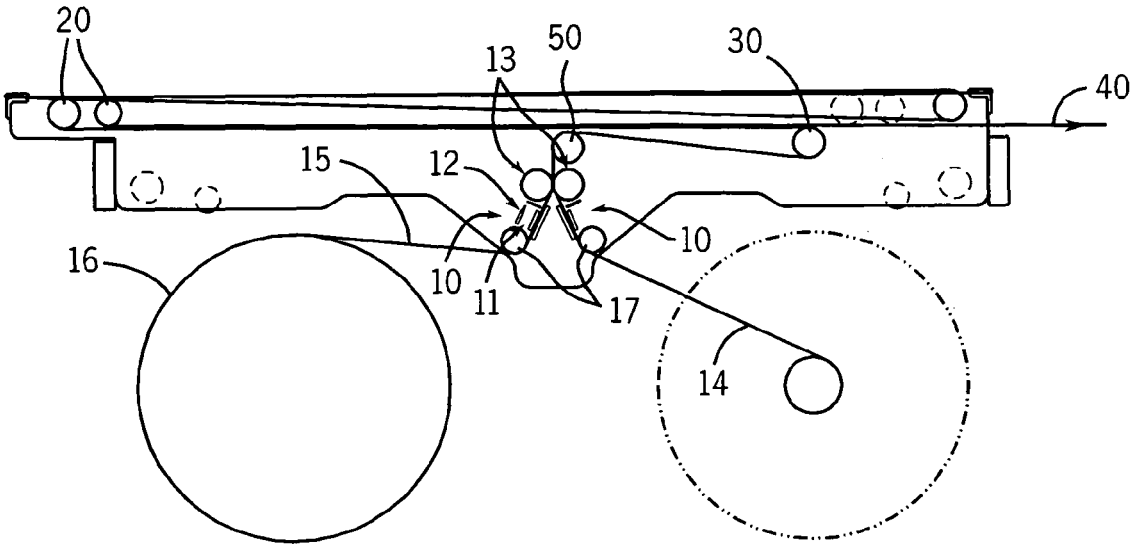
FIG. 1 PRIOR ART
FIG. 1 is a schematic side elevation view of a conventional prior art splicer.
Figure 3:
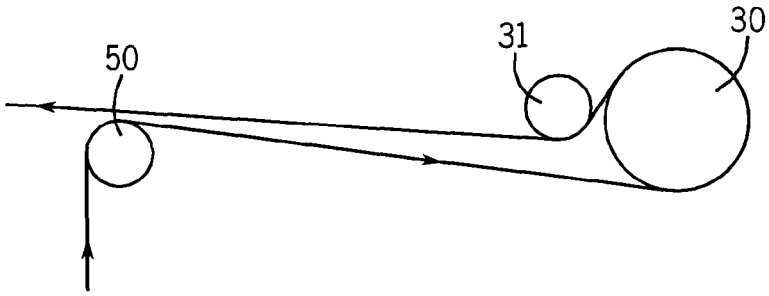
FIG. 3 is a schematic side elevation detail of a modified capstan roll used in one embodiment of the present invention.
Figure 2:
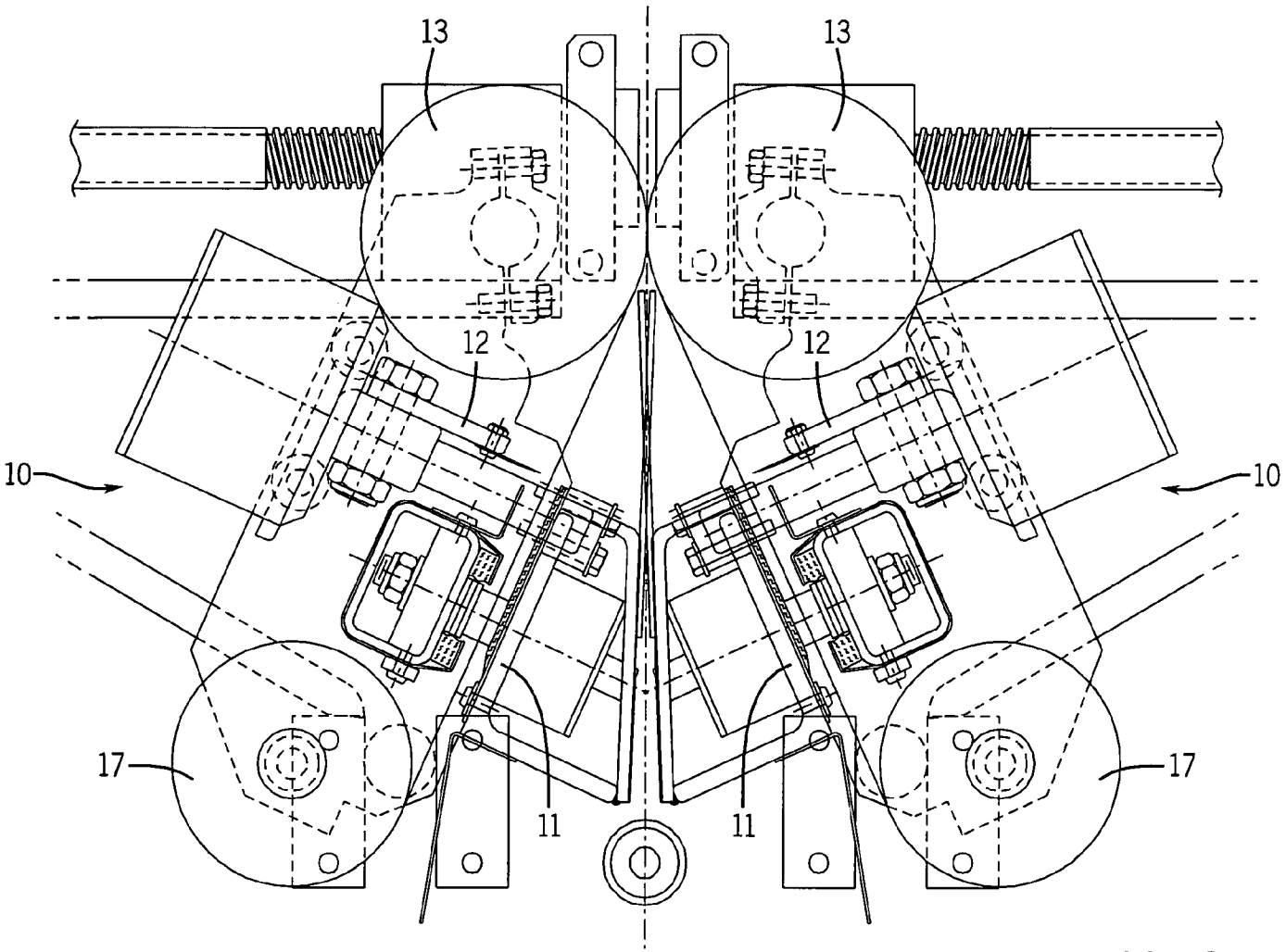
FIG. 2 PRIOR ART
FIG. 2 is an enlarged detail of a conventional splicer head.
Figure 4:
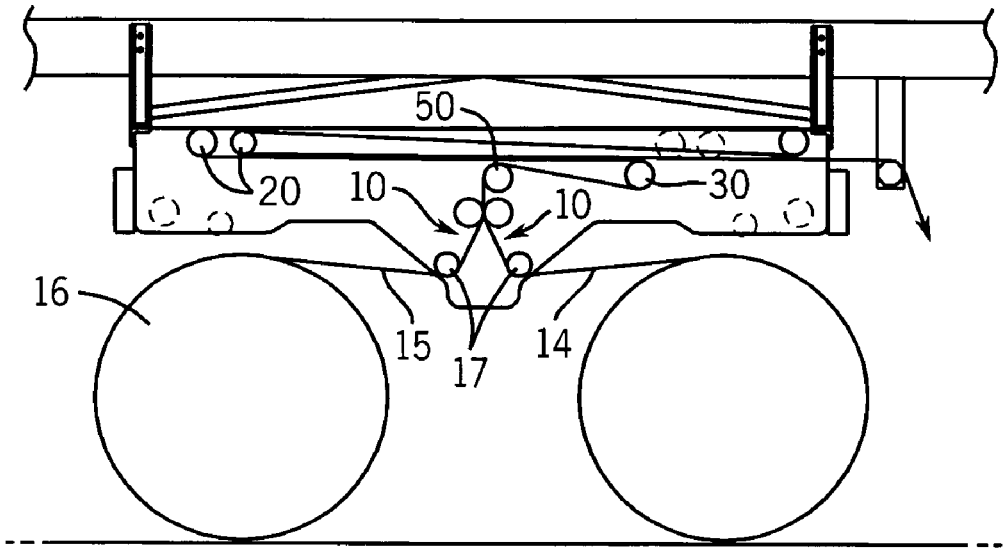
FIG. 4 PRIOR ART
FIG. 4 is a schematic side elevation view of a conventional prior art splicer utilizing dual dancer rolls and a single capstan roll.
Figure 5:
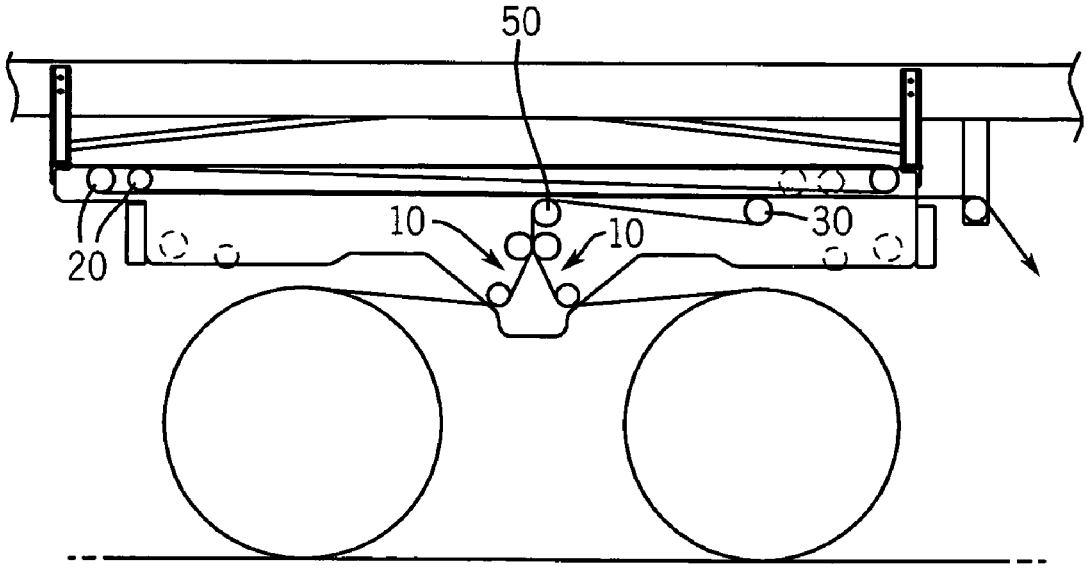
FIG. 5 PRIOR ART
FIG. 5 is a view similar to FIG. 4 showing an extended length frame and dancer storage in a prior art splicer.
Figure 6:
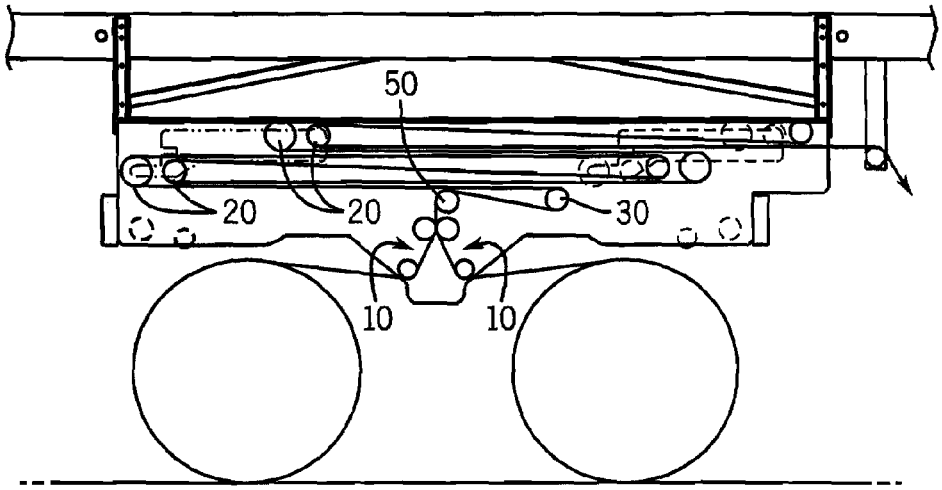
FIG. 6 PRIOR ART
FIG. 6 is a schematic side elevation view of another prior art splicer utilizing a quad dancer construction and a single capstan roll.

Another aspect of the present invention involves the modification of the existing capstan roll to achieve a larger angle of wrap. Referring to FIG. 3, this could be done by increasing the diameter of the capstan roll 30 to 12" and then adding an idler roller 31 to create more wrap on the capstan. This design change would require a larger horsepower capstan drive motor. It would also require the vertical height of the splicer to be increased to accommodate the larger diameter capstan roll. This would limit application of the splicer in many corrugator retrofit situations unless the corrugator bridge was raised. It would also not allow installed machines to be upgraded in the field.

The control for the variable pressure capstan clutch (VPCC) is a device which consists of three main elements inside a 9"×10" Hoffman enclosure. The three main elements are a circuit board, an E/P (electric to pneumatic) transducer, and a volume booster for the E/P. This unit is pre-wired and pre-plumbed so that the VPCC is a single box with external connections for easy assembly onto an existing machine.

At the time a splice sequence occurs, the VPCC gives a pneumatic output to one or two clutches, depending on the number of capstan rolls. These clutches control 5-10 HP motors, which spin at full speed. The clutches engage the motors to capstan rolls, as shown schematically by the motor/clutch arrangement 32 in FIG. 7. The capstan rolls 30, in turn, "pull" a new roll of paper up to speed through torque on the roll and friction between the roll and the paper wrapped around it. The VPCC starts at a very low pressure (10 PSI), and quickly ramps up on a time based signal to a much higher pressure (60 PSI). This may occur, for example, over a time of 2.5 seconds during the splice cycle, while the new roll is getting up to line speed. In the design of the VPCC circuit, the time in which the output increases from its low pressure to its high pressure can be fine tuned to each machine by use of a 26 position potentiometer. This potentiometer controls the low to high time base in 0.5 second increments, from about 0.5 seconds, up to about 8 seconds. This allows fine tuning of the time cycle.

The E/P has a zero potentiometer on it, which allows setting the low pressure anywhere from 0-30 PSI (variable). It also has a span potentiometer on it, which allows us to set the high pressure anywhere from 30-80 PSI (variable). Between the variable settings of the low pressure, high pressure, and time, the pressure ramps between the two set pressures, providing great flexibility for many applications for any splicer which uses a clutch, whether one or multiple motor/clutch combinations.

During the splice cycle, the capstan roll/clutch/motor all work in combination to get the new roll from zero speed, up to line speed. The roll is in contact with the paper, the motor is spinning at its full capable speed, and the clutch interfaces the two together. Setting the clutch pressure too low allows for too low a torque applied to the paper through the capstan roll, resulting in too much time to get the full roll up to speed. Setting the clutch pressure too high causes too much instantaneous torque through the capstan roll, and may tear the paper being pulled. It has been found, by starting the clutch pressure low, and rapidly ramping up the pressure, one can achieve much higher clutch pressures (and get the new roll up to speed more quickly) than by instantaneously applying a large clutch pressure from the start of the cycle. This allows splice at high speeds, and makes all splices, high or low speed, more efficient. The end result is less missed splices and downtime, while also splicing at a higher speed. The concept applies to single clutch/motor design machines, multiple clutch/motor designed machines, or to induction or servomotor motor designed machines. The concept of ramping up the torque to the capstan roll(s) with a time based or dancer roll distance based ramp rate could be accomplished using a variety of ways to do it. The presently preferred embodiment of the invention uses a separate circuit board to create this ramping function, but this can also be done within the logic of a PLC, outputting the voltage to the E/P from this device.

What is claimed is:

1. A method for bringing a new roll of paper web material from zero to corrugator operating speed in a corrugator splicer after effecting a zero speed splice, wherein the splicer includes a dancer roll system located at the downstream output end of the splicer and a motor-driven capstan roll assembly comprising a capstan roll driven by a motor located between a splice sealing apparatus of the splicer and the dancer roll assembly, the capstan roll assembly adapted to apply supplemental tension in the web between the capstan roll assembly and the newly spliced in paper web material, causing the paper roll to accelerate until the paper web unwinding from the spliced-in paper roll achieves corrugator operating speed, the method comprising the steps of:

applying a driving torque to the capstan roll assembly with driving torque to start at an initial level of torque near zero and to increase over a short time period in the range of about 2 to 3 seconds up to a maximum driving torque level achieved when the capstan roll slips beneath the paper web; and achieving an increasing tension in the paper web between the capstan roll and the newly spliced-in paper roll during the short time period that reduces jerk on the paper web and prevents web tear out while accelerating the paper roll until the paper web unwinding from the roll reaches corrugator speed.

2. The method as set forth in claim 1 including the step of discontinuing driving the capstan roll assembly when the paper roll is at corrugator operating speed.

3. The method as set forth in claim 1 including the step of providing a variable pressure pneumatic clutch and operating the variable pressure pneumatic clutch to achieve the increasing tension in the paper web.

4. The method as set forth in claim 3 including utilizing an induction motor to drive the capstan roll.

5. The method as set forth in claim 1 including utilizing a servomotor to drive the capstan roll.

6. The method as set forth in claim 1 wherein the capstan roll assembly comprises a first capstan roll and a second capstan roll located downstream of the first capstan roll, and including the steps of:

driving the first capstan roll to provide an initial level of supplemental tension; and simultaneously driving the second capstan roll to increase tension in the paper web material; and thereby causing a greater tension in the paper web between the capstan roll assembly and the newly spliced-in paper web roll to allow the new paper web roll to be more quickly accelerated to corrugator speed before the paper stored in the downstream dancer roll arrangement is exhausted.

* * * * *

UNITED STATES PATENT AND TRADEMARK OFFICE

CERTIFICATE OF CORRECTION

PATENT NO. : 7,938,925 B2
APPLICATION NO. : 11/435990
DATED : May 10, 2011
INVENTOR(S) : James A. Cummings et al.

It is certified that error appears in the above-identified patent and that said Letters Patent is hereby corrected as shown below:

On the Title Page

Add at:

Item (75) Inventors: Thomas G. Vogel, Green Bay, WI (US).

Signed and Sealed this
Twenty-first Day of June, 2011

David J. Kappos

David J. Kappos
*Director of the United States Patent and Trademark Office*